US005770307A

United States Patent [19]

Rackley et al.

[11] Patent Number: 5,770,307

[45] Date of Patent: Jun. 23, 1998

[54] COEXTRUDED MONOFILAMENTS

[75] Inventors: Robert Lee Rackley; Charles Fletcher Nelson, both of Parkersburg, W. Va.

[73] Assignee: E. I. du Pont de Nemours and Company, Wilmington, Del.

[21] Appl. No.: 721,855

[22] Filed: Sep. 27, 1996

Related U.S. Application Data

[60] Provisional application No. 60/005,542 Oct. 18, 1995.

[51] Int. Cl.[6] ..... D02G 3/00; A46B 00/00; B29C 47/88

[52] U.S. Cl. ..... 428/373; 428/364; 428/374; 428/394; 428/395; 428/397; 428/400; 15/207.2; 264/211.12

[58] Field of Search ..... 428/373, 374, 428/394, 395, 397, 400; 15/207.2; 264/211.12

[56] References Cited

U.S. PATENT DOCUMENTS

| | | | |
|---|---|---|---|
| 2,207,156 | 7/1940 | Neville et al. | 15/207.2 |
| 2,920,947 | 1/1960 | Burk et al. | 51/298 |
| 3,327,339 | 6/1967 | Lemelson | 15/209 |
| 3,577,839 | 5/1971 | Charvat et al. | 15/179 |
| 3,616,480 | 11/1971 | Feroce et al. | 15/207.2 |
| 4,263,691 | 4/1981 | Pakarnseree | 15/159 A |
| 4,459,337 | 7/1984 | Hansen | 428/395 |
| 4,469,739 | 9/1984 | Gretzinger et al. | 428/198 |
| 4,583,564 | 4/1986 | Finkelstein et al. | 132/91 |
| 4,811,447 | 3/1989 | Everson et al. | 15/207.2 |
| 5,128,208 | 7/1992 | Bond et al. | 428/397 |
| 5,313,909 | 5/1994 | Tseng et al. | 116/208 |
| 5,533,789 | 7/1996 | McLarty, III et al. | 297/452.64 |

FOREIGN PATENT DOCUMENTS

| | | |
|---|---|---|
| 0663162 | 7/1995 | European Pat. Off. . |
| 3-099604 | 4/1991 | Japan . |
| 6-141928 | 5/1994 | Japan . |
| 6-169816 | 6/1994 | Japan . |
| 7-231813 | 9/1995 | Japan . |
| 8-187126 | 7/1996 | Japan . |

*Primary Examiner*—Marion E. McCamish
*Assistant Examiner*—J. M. Gray
*Attorney, Agent, or Firm*—James T. Corle

[57] ABSTRACT

This invention relates to a coextruded monofilament having a core material made of a first resin and a sheath material made of a second resin, with the second resin being different from the first resin, and a pocket formed in the end of the monofilament. This invention also relates to a method of forming a pocket in the end of a coextruded monofilament by chemical or mechanical means, or a combination of chemical and mechanical means.

12 Claims, 4 Drawing Sheets

COEXTRUDED MONOFILAMENTS

This application claims the benefit of U.S. provisional application Ser. No. 60/005,542, filed Oct. 18, 1995.

BACKGROUND OF THE INVENTION

1. Field of the Invention

This invention relates to coextruded monofilaments which may be used, for example, in bristles for toothbrushes.

2. Description of the Related Art

Bristles made from nylon 6,12 or from polyester are typically circular in cross section with the ends of the bristles being well rounded. When used in toothbrushes, the rounded ends have been preferred because using bristles with rounded ends have a lower tendency to damage soft and hard oral tissue.

SUMMARY OF THE INVENTION

This invention relates to a coextruded monofilament having a core material made of a first resin and a sheath material made of a second resin, with the second resin being different from the first resin, and a pocket formed in the end of the monofilament.

This invention also relates to a method of forming a pocket in the end of a coextruded monofilament by chemical or mechanical means, or a combination of chemical and mechanical means.

DETAILED DESCRIPTION

This invention relates to a coextruded monofilament of a core material made from a first resin, and a sheath material made from a second resin, wherein the second resin is different from the first resin, and wherein the coextruded monofilament has a pocket formed in the end of the coextruded monofilament. The purpose of this pocket is to hold a material, such as a cleaning material, so that the cleaning material in the monofilament has a longer contact with the surface to be cleaned than if the cleaning material was on the rounded end of a conventional monofilament. For example, if the coextruded monofilament is used in a toothbrush bristle, the pocket will hold toothpaste in contact with a tooth longer than a coextruded monofilament with a conventional rounded end.

Figure 2:
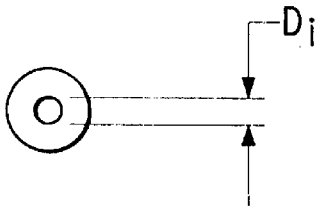
FIG. 2 is a top plan view of the coextruded monofilament of FIG. 1.
Figure 4:
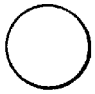
FIG. 4 is a top plan view of the conventional monofilament of FIG. 3.
Figure 1:
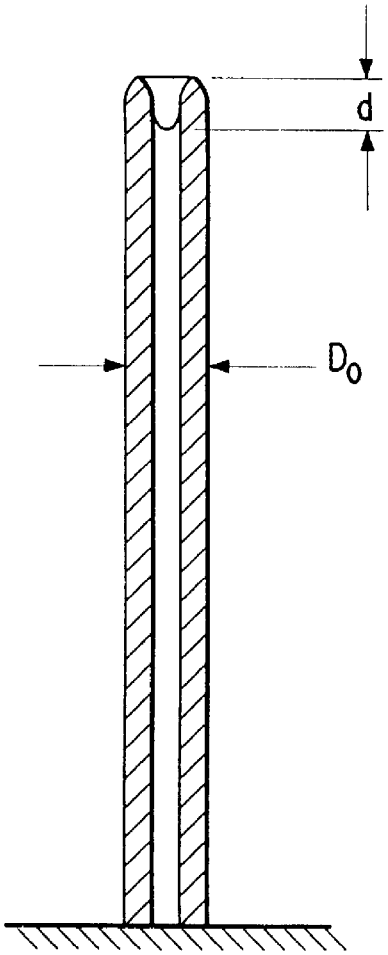
FIG. 1 is a view in cross sectional view in elevation of a coextruded monofilament made in accordance with this invention.

A used herein, the term "core" refers to the central portion, Di of the coextruded monofilament as examined at a cross section as shown in FIG 2. As used herein, the term"sheath" refers to an outer coating layer,Do or layers over the core material on a coextruded monofilament as shown in FIG 1.

Examples of combinations of sheath and core materials include a sheath material of nylon 6; 6,6; 6,10; 6,12; 6,9; 11; 12; copolymers of 6/6,6; 10,10 nylon; and mixtures thereof, and a core material of a copolyester ether such as that sold under the trademark Hytrel® (by E. I. du Pont de Nemours and Company of Wilmington, Del.

Other examples of combinations of sheath and core materials include a sheath material of a nylon, a polyester, especially polyethylene terephthalate (PET) or polybutylene terephthalate (PBT), a polyurethane, polyvinylidene chloride, or mixtures thereof, and a core material of polyvinyl chloride, polyvinyl acetate copolymer, polystyrene, or mixtures thereof.

There is no limitation on the shape of the cross section of either the core or the sheath of the coextruded monofilament. Either or both may be circular, triangular, square, pentagonal, hexagonal, oval, lobate, triocular, tetraocular or any other shape.

The coextruded monofilament may be made by conventional methods known in the art, such as is disclosed in U.S. Pat. No. 5,313,909. It is important that the core and sheath be made from different materials in order to obtain all the benefits of the present invention.

The pocket in the monofilament may be made by mechanical, or by chemical means, or by a combination of mechanical and chemical means.

One method for making the pocket in the end of the monofilament is to abrade the ends of the monofilament with, for example, a fine stainless steel brush in order to form the pocket. An abrasion resistant additive such as polyethylene, silicone oil, or mineral additives such as talc or titanium dioxide may be added to the sheath material so that the core material is preferentially abraded by the mechanical means.

Another method of forming the pocket is by bringing the end of the monofilament into contact with a solvent which will dissolve or degrade the core material, but not the sheath material, in order to form the pocket in the end of the monofilament. The time the monofilament is in contact with the solvent and the temperature of the solvent both affect on the depth of the pocket.

If the core material is a copolyester ether, then a suitable solvent is methylene chloride, antine, carbon tetrachloride, chlorosulfonic acid, ethyl chloride, ethylene dichloride, hydrazine, 37% hydrochloric acid, perchloroethylene, phenol, nitric acid, sulfuric acids, or 110° F. steam. Most of these solvents have little effect on nylons especially for short exposure times.

If the core material is a polyvinyl chloride, polyvinyl acetate copolymer, polystyrene, or mixtures thereof, then a suitable solvent is acetone.

Other examples of sheath and core polymers are a sheath polymer of nylon 6,10 or nylon 6,12 with a core polymer of nylon 6 or nylon 6,6. For such a coextruded monofilament, dilute hydrochloric acid is a suitable solvent to be used to form a pocket in the end of the coextruded monofilament.

Another example of a coextruded monofilament of this invention is a sheath polymer of nylon 6,12 and a core polymer of nylon 6,10. A 90% formic acid solution is a suitable solvent to be used to form a pocket in the end of the coextruded monofilament.

Another way to form the pocket in a coextruded monofilament is to add a ultraviolet light inhibitor to the sheath polymer but not the core polymer, and expose the coextruded monofilament to intense ultraviolet light to preferentially degrade the core in the end of the coextruded monofilament. The coextruded monofilament may then be subject to further mechanical treatment, if necessary, to form the pocket to desired proportions.

The depth of the pocket should be from about 0.001 to 0.250 inches (0.025 to 6.4 millimeters).

The diameter of the coextruded monofilament should be from about 0.001 to 0.100 inches (0.025 to 2.5 millimeters), and the ratio of the area of the core to the area of the coextruded monofilament should be from about 0.1 to about 0.9, with a preferred ratio being from about 0.25 to about 0.75.

The monofilaments may be grouped together in tufts, and attached to a brush. Examples of the types of brush in which these monofilaments may be used include a toothbrush, and a paintbrush, but this invention is not limited to any specific type of brush, and may be used in any type of brush.

The ends of the coextruded monofilaments of this invention may be flagged by conventional means. The term "flagging" means that the ends of the inventive coextruded monofilaments having pockets form in their ends may be split by conventional means from the end of the monofilament to the bottom of the pocket to form what are known as "flags" in the ends of the monofilament. These flags include a concave portion of the pocket and provide the same benefits as the coextruded monofilaments having pockets in the ends that are not flagged.

EXAMPLES

Example 1

Coextruded monofilaments having a core of Hytrel® 4056 trademark of E. I. du Pont de Nemours and Company for its copolyester ether and a sheath of nylon 612 were made using conventional methods. The monofilament was conditioned at 125° C. by backwinding it through a conditioner on a spinning line and then processed into hanks. The cross sectional area of the core was 25% of the total cross sectional area of the monofilament.

These coextruded monofilaments were tufted into a tuft toothbrush and the ends of the monofilaments were subjected to conventional end rounding.

Figure 7:
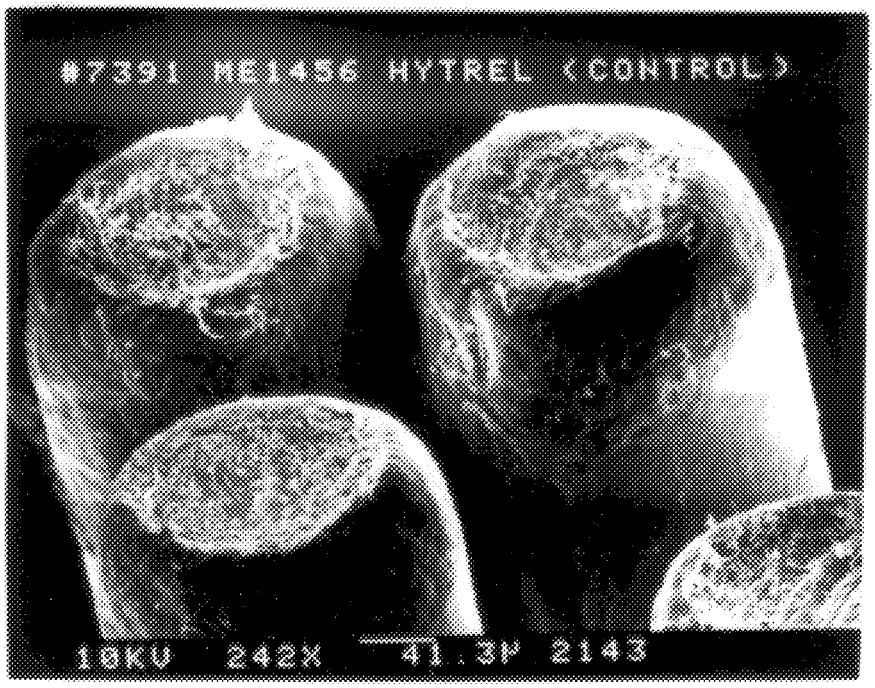
FIG. 7 is a scanning electron microscope photograph at a magnification of 242× of a pocket formed in the end of a coextruded monofilament of this invention.

A fine stainless steel brush having 0.003 inch stainless steel bristles was used to abrade the ends of the coextruded monofilaments in the tufts for about 2–3 minutes to form pockets in the end of the monofilaments as is shown in FIG. 7.

The stainless steel brush was 3 inches (76.2 mm) in diameter and was rotated at 1200 rpm. About 0.5 inches (12.7 mm) interference between the stainless steel brush and the bristles was used. Hence the sides and ends of the bristles were abraded but since the core material was a softer resin a small 0.002 inch deep pocket was formed in the end of the bristle.

Example 2—Comparative Example

A coextruded monofilament having a core of PET and a sheath of nylon 6,12 was made as in Example 1, except that the conditioning temperature was 175° C. The cross sectional area of the core was 50% PET. A higher conditioning temperature was used than in Example 1 because the melt point of the Example 1 core was 150° C. and the PET core of this Example had a higher melt point of 255° C. so a standard nylon 6,12 conditioning temperature was used.

Figure 3:
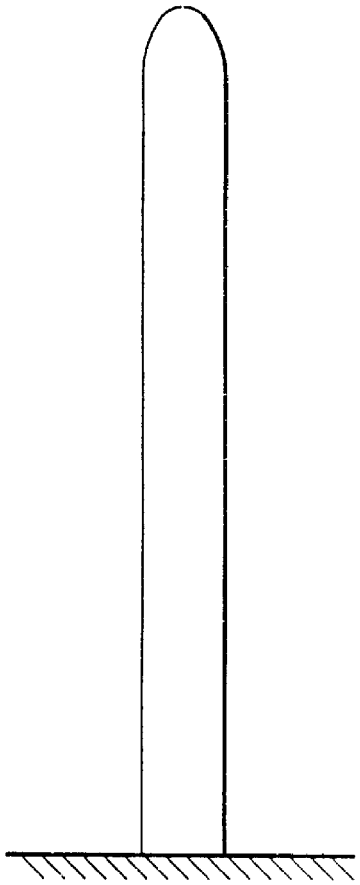
FIG. 3 is a view in elevation of a conventional monofilament.

The bristles were processed into toothbrushes like Example 1 and were subjected to a similar mechanical treatment with a stainless steel brush. However in this example no pockets were formed because the PET core was not preferentially abraded. Hence the bristle tip had a profile like that as shown in FIG. 3. A combined mechanical and chemical treatment would be required to form a pocket in the end of the coextruded monofilament having a sheath-core combination of this Example.

Example 3

A coextruded monofilament having a sheath of nylon 6,12 and a core of PBT was made as in Example 2. The cross sectional area of the sheath was 70% of the cross sectional area of the monofilament.

Figure 5:
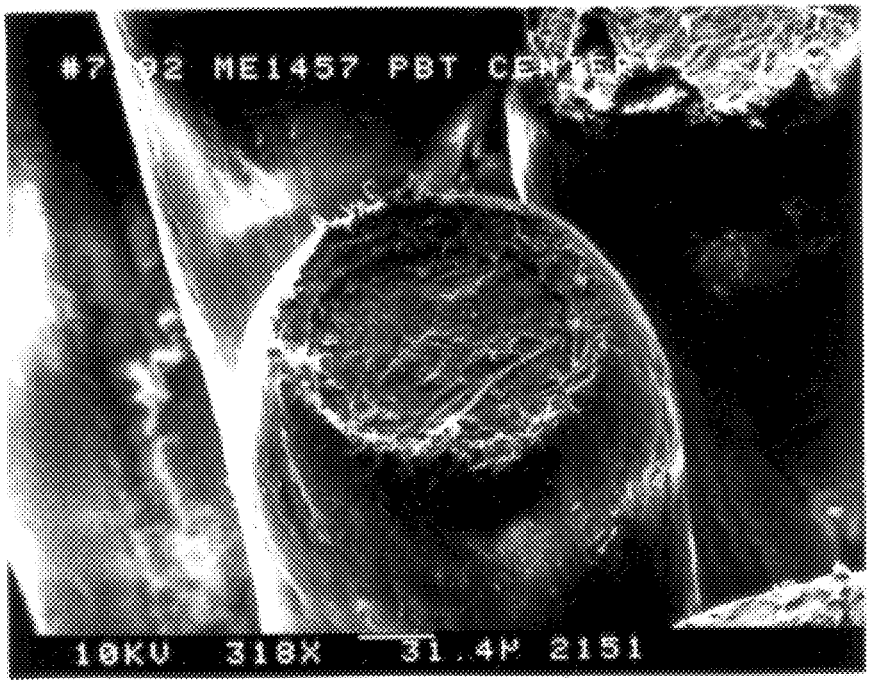
FIG. 5 is a scanning electron microscope photograph at a magnification of 318× of a pocket formed in the end of a coextruded monofilament of this invention.

Toothbrushes were made from the coextruded monofilaments as in Examples 1 and 2, and the ends of the monofilaments were abraded with a stainless steel brush for about 2–3 minutes. As may be seen in FIG. 5, the monofilaments had an appearance similar to the monofilaments of Example 1 although the pocket formed was not as deep as in Example 1. The 70% core did cause a wider pocket to be formed than the pocket in Example 1.

Example 4

Coextruded monofilaments were made as in Example 1 and were bundled together into approximately two inch diameter bundles. The ends of the coextruded monofilament in the bundle were abraded with the same stainless wire brush as used in Example 1, except that the abrasion took place for about 15 minutes. The center sections of the coextruded monofilaments were indented as in Example 1 to form a pocket which demonstrated that the coextruded monofilaments of this invention may be processed as bundles as well as toothbrushes.

Example 5

Figure 6:
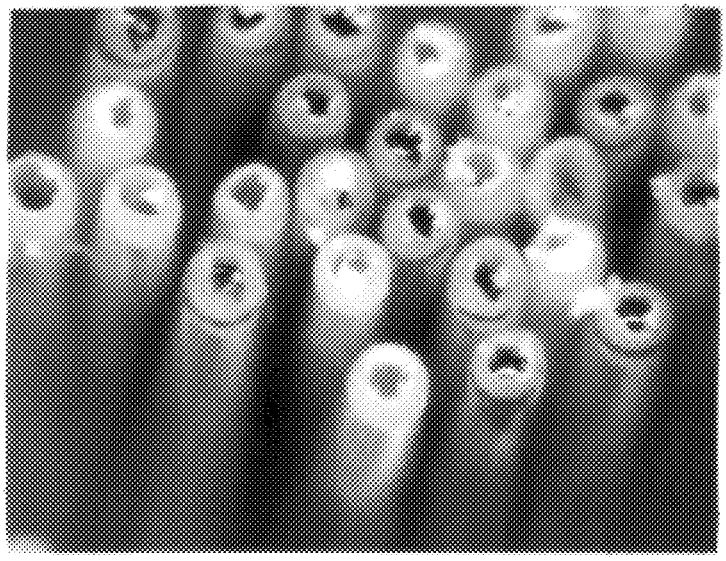
FIG. 6 is a 50× magnified photograph of a pocket formed in the end of a coextruded monofilament of this invention.
Figure 8:
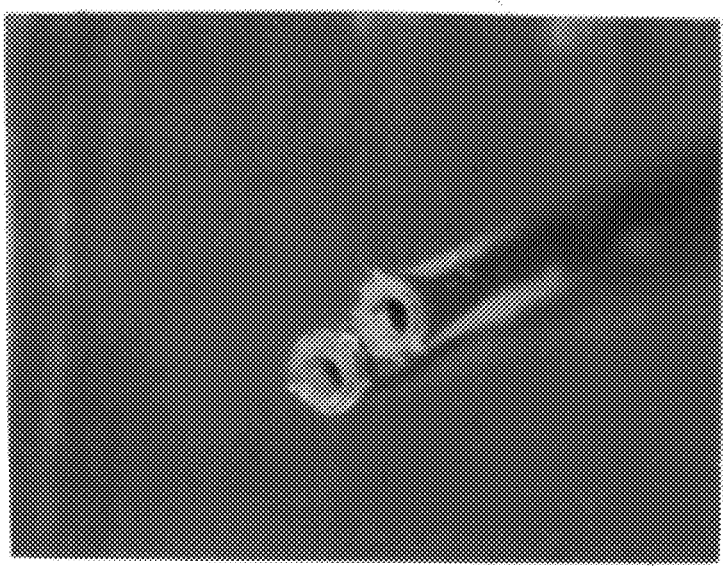
FIG. 8 is a magnified photograph of a pocket formed in the end of a coextruded monofilament of this invention.

Toothbrushes having coextruded monofilaments were made as in Example 1, but were treated chemically rather than mechanically. The ends of the coextruded monofilaments of a toothbrush were exposed to methylene chloride for about 12 minutes, which is a strong solvent for Hytrel® copolyester ether but is not a solvent for nylon 6,12. The cores of the ends of the coextruded monofilaments were dissolved to form pockets, and the coextruded monofilaments were subjected to mechanical abrasion for about 1–3 minutes to smooth the ends of the monofilaments. Photographs of the bristles are shown in FIG. 6 and FIG. 8.

Example 6

Figure 9:
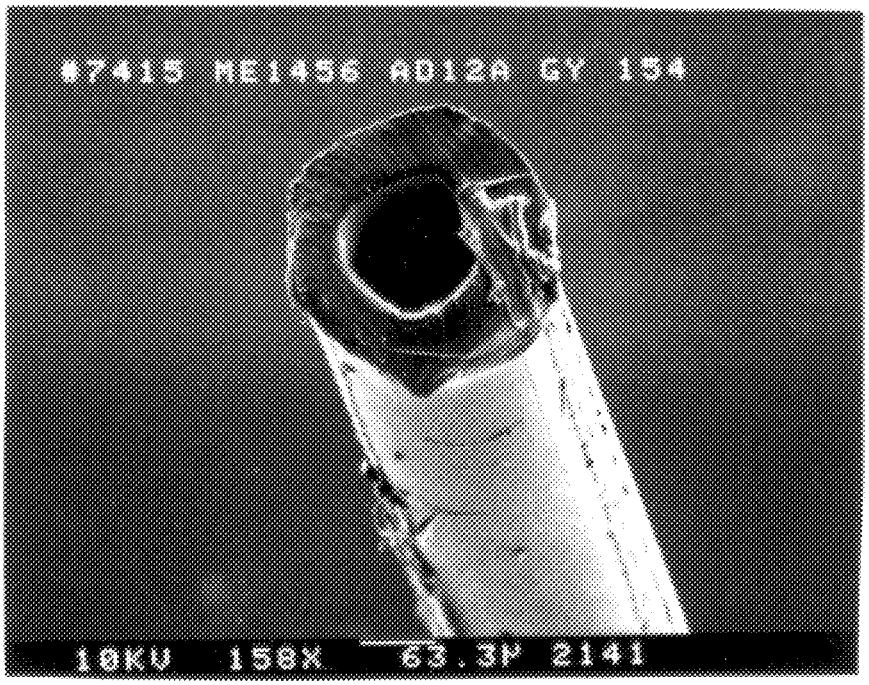
FIG. 9 is a scanning electron microscope photograph at a magnification of 158× of a pocket formed in the end of a coextruded monofilament of this invention.
Figure 10:
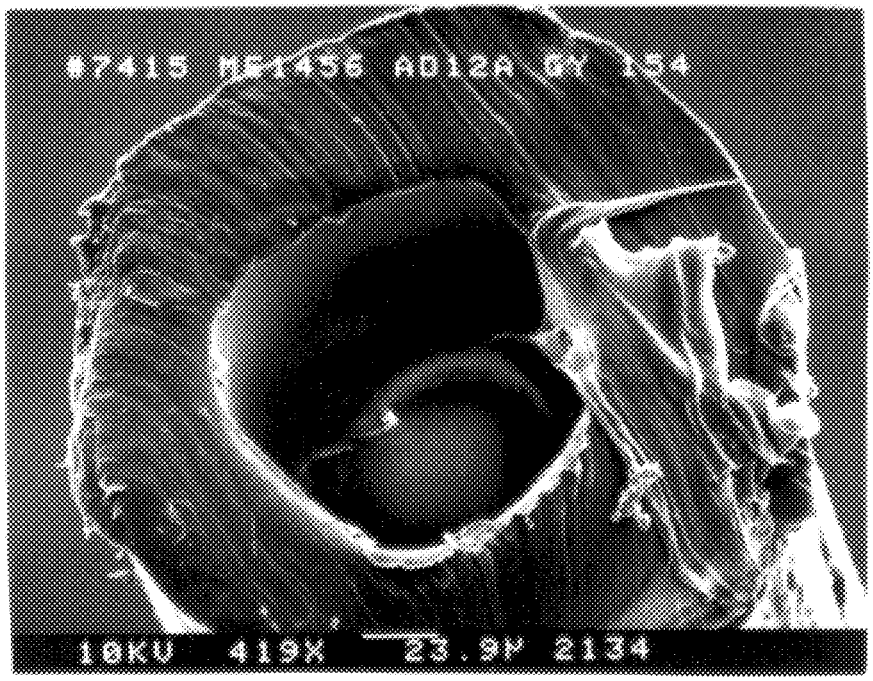
FIG. 10 is a magnified photograph at a magnification of 419× of a pocket formed in the end of a coextruded monofilament of this invention.

A bundle of coextruded monofilaments was made as in Example 4, and the ends of the monofilaments were treated by dipping the ends into a shallow bath of methylene chloride for about 10 minutes to form pockets in the ends of the monofilaments. The ends of the monofilaments were subjected to mechanical treatment with the stainless steel brush of Example 1 to round the ends of the monofilaments. These bristles are shown at a magnification of 158× in FIG. 9 and a magnification of 419× in FIG. 10. By comparison of the depth of the pocket to the width it was estimated that the pocket formed in this Example was about 0.004 inches (0.1 mm) deep.

Example 7—Comparative Example

A coextruded monofilament was made having a nylon 6, 12 sheath and a nylon 6, 12 core with the cross sectional area of both the sheath and the core being 50% of the cross sectional area of the monofilament. The monofilament was extruded and conditioned as in Example 3, and processed into brushes. The ends of the monofilament were abraded with a stainless steel brush as in Example 3. No pocket was formed in the ends of the monofilaments, and the ends had a normal rounded appearance such as is shown in FIG. 3.

What is claimed is:

1. A coextruded monofilament comprising:

a core material of a first resin, a sheath material of a second resin, said second resin being different from said first resin, and a pocket formed in the end of the monofilament.

2. The coextruded monofilament of claim 1, wherein sheath material is nylon 6; nylon 6,6; nylon 6,10; nylon 6,12; nylon 6,9; nylon 11; nylon 12; copolymers of nylon 6 and nylon 6,6; 10,10 nylon; and mixtures thereof, and the core material is a copolyester ether.

3. The coextruded monofilament of claim 1, wherein the sheath material is a nylon, a polyester, a polyurethane, polyvinylidene chloride, or mixtures thereof, and the core material is a polyvinyl chloride, polyvinyl acetate copolymer, polystyrene, or mixtures thereof.

4. The coextruded monofilament of claim 1, wherein the sheath material is nylon 6, 10 or nylon 6, 12, and the core material is nylon 6, nylon 6,6, nylon 6,10 or polybutylene terephthalate.

5. The coextruded monofilament of claim 1, wherein the cross-sectional area of the core material comprises from about 10 to about 90% of the cross-sectional area of the monofilament.

6. The coextruded monofilament of claim 1, wherein the cross-sectional area of the core material comprises from about 25 to about 75% of the cross-sectional area of the filament.

7. The coextruded monofilament of claim 1, wherein the depth of the pocket is from about 0.001 to about 0.250 inches from the end of the monofilament.

8. The coextruded monofilament of claim 1, wherein the cross sectional shape of the sheath is circular, triangular, square, pentagonal, hexagonal, oval, lobate, triocular or tetraocular.

9. The coextruded monofilament of claim 1 wherein the ends of the coextruded monofilament are flagged.

10. A bundle comprising a plurality of the coextruded monofilaments of claim 1.

11. A method for forming a pocket in the end of a coextruded monofilament comprising the steps of providing a monofilament having a core material of a first resin and a sheath material of a second resin, said second resin being different from said first resin, and abrading the core of the monofilament to form a pocket in the end of the monofilament.

12. A method for forming a pocket in the end of a coextruded monofilament comprising the steps of providing a monofilament having a core material of a first resin wherein said core material is a copolyester ether, and a sheath material of a second resin wherein said second resin is selected from the group consisting of nylon 6; nylon 6,6; nylon 6,10; nylon 6,12; nylon 6,9; nylon 11, nylon 12 copolymers of nylon 6 and nylon 6,6; nylon 6,10; nylon 10,10; and mixtures thereof (being different from said first resin), and bringing the end of the monofilament in contact with a solvent that dissolves the core material but not the sheath material to form a pocket in the end of the monofilament.

* * * * *